US006945875B2

(12) United States Patent
Gauer

(10) Patent No.: US 6,945,875 B2
(45) Date of Patent: Sep. 20, 2005

(54) GOLF TRAINING DEVICE

(76) Inventor: Richard Gauer, 226 Long Pond Rd., Hewitt, NJ (US) 07421

( * ) Notice: Subject to any disclaimer, the term of this patent is extended or adjusted under 35 U.S.C. 154(b) by 0 days.

(21) Appl. No.: 10/954,562

(22) Filed: Sep. 30, 2004

(65) Prior Publication Data

US 2005/0075188 A1 Apr. 7, 2005

Related U.S. Application Data

(60) Provisional application No. 60/507,553, filed on Oct. 1, 2003.

(51) Int. Cl.[7] ..... A63B 69/36

(52) U.S. Cl. ..... 473/270; 473/218; 473/257; 473/266

(58) Field of Search ..... 473/219, 257, 473/266, 268, 269, 270, 272, 273, 278, 279

(56) References Cited

U.S. PATENT DOCUMENTS

| | | | | |
|---|---|---|---|---|
| 1,484,064 A | | 2/1924 | Erickson et al. | |
| 2,150,580 A | * | 3/1939 | Crowley | 473/273 |
| 2,169,407 A | * | 8/1939 | Crowley | 473/272 |
| 2,790,642 A | * | 4/1957 | Rolfe | 473/272 |
| 3,424,462 A | | 1/1969 | Driscoll | |
| 3,580,584 A | * | 5/1971 | Trosko | 473/218 |
| 3,658,344 A | * | 4/1972 | Kimble | 473/272 |
| 3,679,206 A | * | 7/1972 | Shambaugh | 473/257 |
| 3,758,117 A | | 9/1973 | Harrison | |
| 3,868,116 A | * | 2/1975 | Ford et al. | 473/218 |
| 3,992,013 A | | 11/1976 | Golden | |
| 4,095,797 A | | 6/1978 | Breese | |
| 4,355,810 A | | 10/1982 | Rydeck | |
| 4,434,983 A | * | 3/1984 | Taggart | 473/273 |
| 4,789,158 A | | 12/1988 | Chiesa | |
| 4,915,387 A | * | 4/1990 | Baxstrom | 473/218 |
| 5,108,106 A | * | 4/1992 | Cook | 473/272 |
| 5,158,297 A | | 10/1992 | Johnson | |
| 5,398,937 A | | 3/1995 | Regan | |
| 5,527,037 A | * | 6/1996 | Matsumoto | 473/218 |
| 5,590,882 A | | 1/1997 | Todd | |
| 5,707,301 A | * | 1/1998 | Tollin | 473/257 |
| 5,893,805 A | * | 4/1999 | Douglass | 473/218 |
| 6,514,151 B2 | | 2/2003 | Delaplane | |
| 6,592,376 B1 | | 7/2003 | Carpenter | |

FOREIGN PATENT DOCUMENTS

| | | |
|---|---|---|
| GB | 2 066 083 | 8/1981 |
| GB | 2 277 272 | 10/1994 |
| WO | WO 95/04577 | 2/1995 |

* cited by examiner

*Primary Examiner*—Mark S. Graham
*Assistant Examiner*—Nini F. Legesse
(74) *Attorney, Agent, or Firm*—Gerald E. Hespos; Anthony J. Casella

(57) ABSTRACT

The golf training device includes a foot alignment strip generally in the form of an arrow that can be pointed towards a target. A ball alignment marker extends perpendicularly from an intermediate position along the foot alignment strip and can be pointed towards the golf ball. A hand alignment guide defines an arc that extends from the ball alignment marker to provide a visible cue that identifies a preferred path of movement of the hand through a golf swing. The shaft alignment line extend transversely across the hand alignment marker to identify preferred shaft positions at various points during a golf swing.

9 Claims, 2 Drawing Sheets

GOLF TRAINING DEVICE

This application claims priority on U.S. Provisional Patent Appl. No. 60/507,553, filed Oct. 1, 2003.

BACKGROUND OF THE INVENTION

1. Field of the Invention

The invention relates to a golf training device to help a golfer develop a swing with proper hand position, proper club shaft alignment and appropriate power.

2. Description of the Related Art

Amateur golfers often are frustrated by their inability to achieve consistency from one golf shot to the next. The occasional long true shot for most amateur golfers is likely to be the high point in an afternoon of slices, hooks or otherwise ineffective golf shots.

Amateur golfers spend small fortunes on lessons in an effort to develop consistency, accuracy and/or strength. However, the various requirements for a golf swing (e.g., grip, stance, back swing, follow through etc.) often lead to series of disjointed motions with poor performance through the most important parts of the swing.

The patent literature is replete with prior art attempts to develop training devices that are intended to improve a golf game. Some golf training devices are designed to develop a preferred position for various body parts at various points during a golf swing. Some such devices are worn by the golfer during a training session, while others are positioned near the golfer. Many of these training devices are intended to guide the golfer's hands, arms, shoulders and/or hips or the head of the golf club through an appropriate arc as the golfer carries out the back swing and/or follow through. However, devices worn by a golfer or devices that physically guide portions of the golfer's body or the golf club into or through a swing create a significantly likelihood that the golfer will rely upon the apparatus and will perform differently when the apparatus is not being used or worn. Thus, a golfer may be forced to guide his or her hands through a proper arc when the hands or the golf club are physically guided by a training device. However, once the golfer steps away from the training device, there is a substantial likelihood that the body and club will divert significantly from the precise positions required by the apparatus.

In view of the above, it is an object of the subject invention to provide a golf training device that is not worn by a golfer.

Another object of the subject invention is to provide a golf training device that does not contact any part of the golfer or golf club at any time during a swing.

A further object of the subject invention is to provide a golf training device that focuses only upon aspects of the golf swing occurring at a narrow range of critical times in the golf swing.

SUMMARY OF THE INVENTION

A golf training device in accordance with the invention includes a foot alignment strip with opposite leading and trailing ends. The foot alignment strip preferably is configured and dimensioned to be placed on the ground about halfway between the golfer and the golf ball so that the foot alignment strip points towards the target. The golfer uses this part of the golf training device by assuming a stance with the front of each foot approximately an equal distance from the line defined by the foot alignment strip. Thus, the golfer's feet will be on a line generally directed toward the target.

The golf training device further includes a ball alignment marker. The ball alignment marker preferably is mounted removably on the foot alignment strip and preferably is about midway along the length of the foot alignment strip. The ball alignment marker preferably includes an arrow or other directional indicator that extends substantially perpendicular to the foot alignment strip and is positioned to point towards the ball when the foot alignment strip points toward the target. During normal use of the golf training device, the arrow of the ball alignment marker and the ball will both lie in a vertical plane that is perpendicular to a vertical plane that includes both the longitudinal axis of the foot alignment strip and the target.

The golf training device may further include at least one head positioning means corresponding to a preferred head position. The head positioning means may be indicia, a projection or an aperture at an approximate location on the alignment marker or the foot alignment strip. The head positioning means preferably is rearward of the ball and provides a visual cue to identify a preferred head position relative to the ball for most golfers and most golf clubs. In this regard, the golfer's hands desirably should be ahead of the golfer's head at the bottom of the swing for most clubs.

The golf training device further includes a hand alignment guide that extends rearwardly from a location on or near the ball alignment marker. The hand alignment guide extends through an arc with a concave side facing towards both the golfer and the foot alignment strip. The arc defined by the hand alignment guide preferably is generated about a center that is approximately coincident with the vertical axis about which the golfer's hands should move. However, the hand alignment guide is radially outward from the hands so that the golfer's hands and the hand alignment both are within and generally along the golfer's line of vision.

The front end of the hand alignment guide preferably is pivotally joined to the ball alignment marker. Additionally, the hand alignment guide preferably includes front and rear arc segments that are connected pivotally to one another. The pivotal connections of the front arc are segment to both the ball alignment marker and the rear arc segment facilitates packing and shipping by the manufacturer and facilitates storage and carrying by the golfer.

The top surface of the hand alignment guide has indicia grooves, ribs or other markings. In particular, a ball alignment line preferably extends through the pivotal connection of the hand alignment guide and the ball alignment marker. The hand alignment guide is pivoted until the ball alignment line is coincident with the arrow of the ball alignment marker to ensure proper pivotal positioning of the hand alignment marker. Second, indicia may extend along the lengths of the front and rear arc segments to facilitate proper pivotal alignment of the front and rear arc segments relative to one another. Third, shaft alignment lines extend transversely across the hand alignment guide at a plurality of positions to identify several optimum shaft alignments at several positioning during the swing. The forward-most shaft alignment line defines the preferred shaft angle as the hands reach the bottom of the ball alignment line. The rearward-most shaft alignment is approximately parallel to the foot alignment strip to define a preferred shaft alignment as the hands and shaft enter the golfers field of peripheral vision.

The golf training device may further include a hook pivot point and a slice pivot point. The hook pivot point will define a preferred hand pivot location for a golfer who is intentionally trying to incorporate a hook into a swing. In this regard, a hook pivot point is rearward of the center ball alignment arrow. Conversely, the slice pivot point will be forward of the center ball alignment arrow and will define a preferred hand pivot location for a golfer who is trying to incorporate a slice into a swing. The hook pivot point and the slice pivot points also may be used by golfers in an effort to overcome a troublesome hook or slice in the golf swing. Thus, a golfer with an unintended slice may try to have the hands aligned closer to the hook pivot point when the hands are at the bottom of the swing.

The golf training device of the subject invention may further include strips of tape or a roll of tape from which strips may be withdrawn. The tape or other such applicator may be applied to the shaft of the golf club for training purposes. The tape preferably is a bright color consistent with the color and/or brightness of the shaft alignment lines. The tape or other such visual cue applied to the shaft of the golf club will help the golfer align the shaft parallel to the shaft alignment strip.

The golf training device is employed by connecting the ball alignment marker to the foot alignment strip. The front and rear arcs then are pivoted into an open position and to extend rearwardly from the ball alignment marker. The foot alignment strip then is positioned about halfway between the ball and the golfer. More particularly, the foot alignment strip is aligned angularly to point towards the target and is positioned longitudinally so that the ball alignment marker points toward the golf ball. The golfer then assumes a stance with the toes of the golfer approximately equally spaced from the foot alignment strip. Thus, the toes of the golfer will define a line substantially pointing towards the target. Additionally, the golfer's stance is selected so that the golfer's head is aligned with the head alignment indicia.

The golfer then takes his or her normal swing at the golf ball. The golfer may visually follow the movement of the hands and the shaft during the first several practice swings with the device. However, the golfer eventually will rely upon peripheral vision to track the hands and the shaft alignment relative to the hand alignment guide. The hands and golf shaft will move into the peripheral field of vision for the golfer approximately as the hands reach the rear end of the hand alignment guide. At this point, the hands will be slightly inward from the rear arc segment of the hand alignment guide and the shaft should align with or be parallel to the rearward most shaft alignment line. The golfer then will manage the swing so that the hands remain parallel to and inward of hand alignment guide and so that the shaft of the golf club substantially parallels the shaft alignment lines. Accordingly, the golfer will be able to keep the shaft of the golf club at approximately an angle of 20°–40° to the ball alignment marker when the hands are at or near the bottom of the swing. The natural mechanics of the golf swing then will cause the golfer to whip the shaft head through this last 20°–40° as the golfer is completing the golf swing and starting the follow through.

The golf training device of the subject invention allows the golfer to focus visually on the important shaft alignment at the critical point in the golf swing without concentrating on too many other aspects of the golf swing.

DETAILED DESCRIPTION OF THE PREFERRED EMBODIMENT

Figure 1:
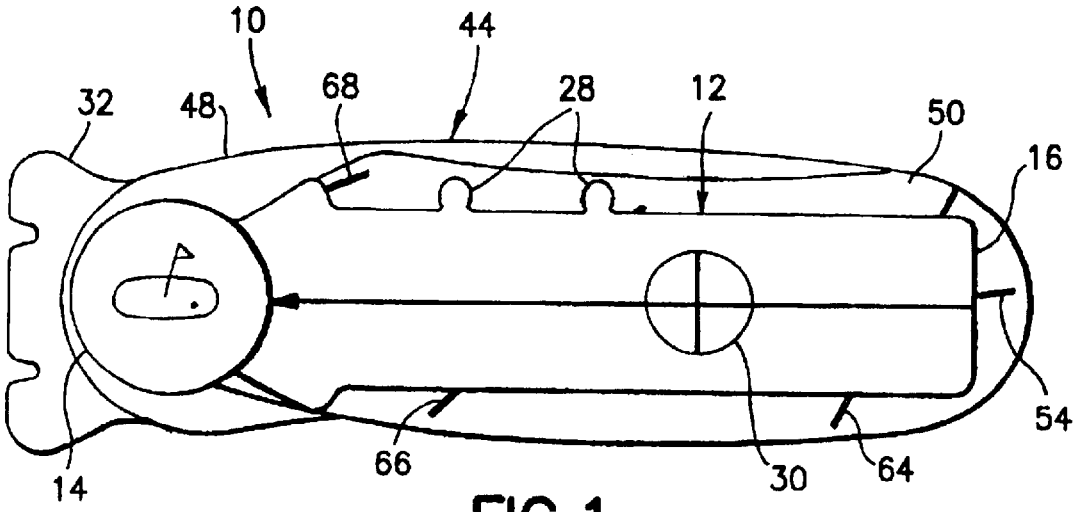
FIG. 1 is a top plan view of a golf training device in accordance with the invention in a folded condition.
Figure 2:
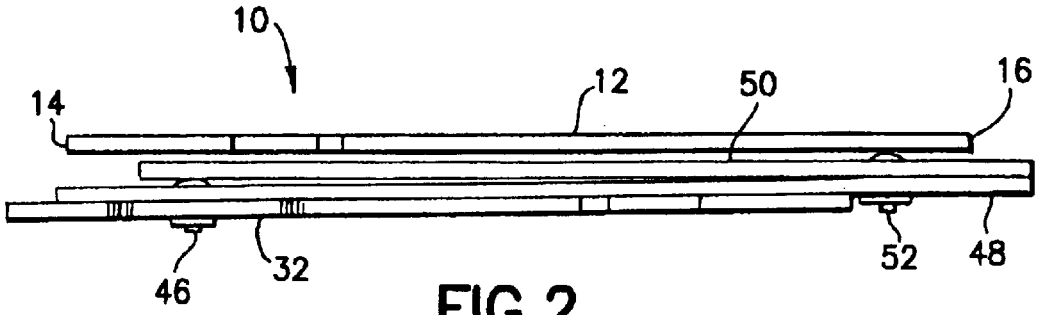
FIG. 2 is a side elevational view of the golf training device shown in FIG. 1.

A golf training device in accordance with the subject invention is identified generally by the numeral 10 in FIGS. 1 and 2. The golf training device 10 includes an elongate foot alignment strip 12 that preferably is formed from a planar flexible sheet of resin material. The foot alignment strip 12 has opposite leading and trailing ends 14 and 16 defining a total length for the foot alignment strip 12 about 10–18 inches (25–45 cm). The leading end 14 is tapered to a point formed symmetrically on the foot alignment strip 12. The width of the foot alignment strip 12 is less critical. However, the foot alignment strip 12 should be sufficiently wide to maintain dimensional stability and a substantially planar condition for the foot alignment strip 12 during use. A preferred width for the foot alignment strip is in the range of 2–3 inches (i.e., 5–8 cm). The foot alignment strip 12 includes a bottom surface 18 and an opposite top surface 20. The bottom surface 18 may be formed with a plurality of anti-slip spikes (not shown) that project a sufficient distance to hold the golf training device 10 in a stable manner on a supporting surface, such as a practice tee. The spikes may be formed unitarily with the foot alignment strip 12 and typically will project in the range of 0.25–0.50 inch. Spikes of this type are used commonly on the bottom surface of automobile floor mats.

The foot alignment strip 12 includes opposite proximal and distal side edges 24 and 26 respectively. The proximal side edge 24 is substantially linear along its entire length from the trailing end 16 to the start of the tapered point at the leading end 14. The distal side edge 26 also is substantially linear along most of its length. However, the distal side edge 26 includes two mounting projections 28 that project outwardly at a location approximately midway along the length of the foot alignment strip 12.

The top surface 20 of the foot alignment strip 12 includes a head position marker 30. The head position marker 30 includes indicia for identifying the marker 30 as the preferred head position.

The top surface 20 of the foot alignment strip 12 may further have indicia to emphasize a few instructions and golf tips. For example, indicia near the leading end 14 of the foot alignment strip 12 may include an arrow and the phrase "Align to Target". Indicia near the head position marker 30 instruct the golfer to "Keep shoulders parallel to this arrow" and identify the head position marker 30 as "Head Location".

The golf training device 10 further includes a ball alignment marker 32 mounted to the mounting projections 28 on the distal side edge 26 of the foot alignment strip 12. The ball alignment marker 32 includes a ball alignment arrow 34 aligned substantially perpendicular to the longitudinal axis of the foot alignment strip 12 at a location aligned approximately with the longitudinal midpoint of the foot alignment strip 12.

The golf training device 10 further includes a hand alignment guide 44 pivotally mounted to the ball alignment marker 32 at a front pivot point 46 coincident with the ball alignment arrow 34 and at a position on the ball alignment marker 32 relatively close to the foot alignment strip 12. A preferred positioning of the pivot point 46 to the foot alignment strip 12 is about 2–4 inches (5–10 cm). The hand alignment guide 44 has front and rear arc segments 48 and 50 that are pivotally connected to one another at a rear pivot point 52. The pivotal connection of the front arc segment 48 to both the ball alignment marker 32 and the rear arc segment 50 facilitates packaging and storage and prevents the respective parts from being lost by the golfer. In particular, the front arc segment 48 can be pivoted about the front pivot point 46 to substantially coincide with the ball alignment marker 32 and the rear arc segment 50 can be pivoted about the rear pivot point 52 into a position substantially coincident with the front arc segment 48. This folded assembly of the ball alignment marker 32, the front arc segment 48 and the rear arc segment 50 can be positioned on top of the foot alignment strip 12 to provide a very compact assembly that easily can be stored in a package for sale and that subsequently can be stored in a compartment in most golf bags.

Figure 3:
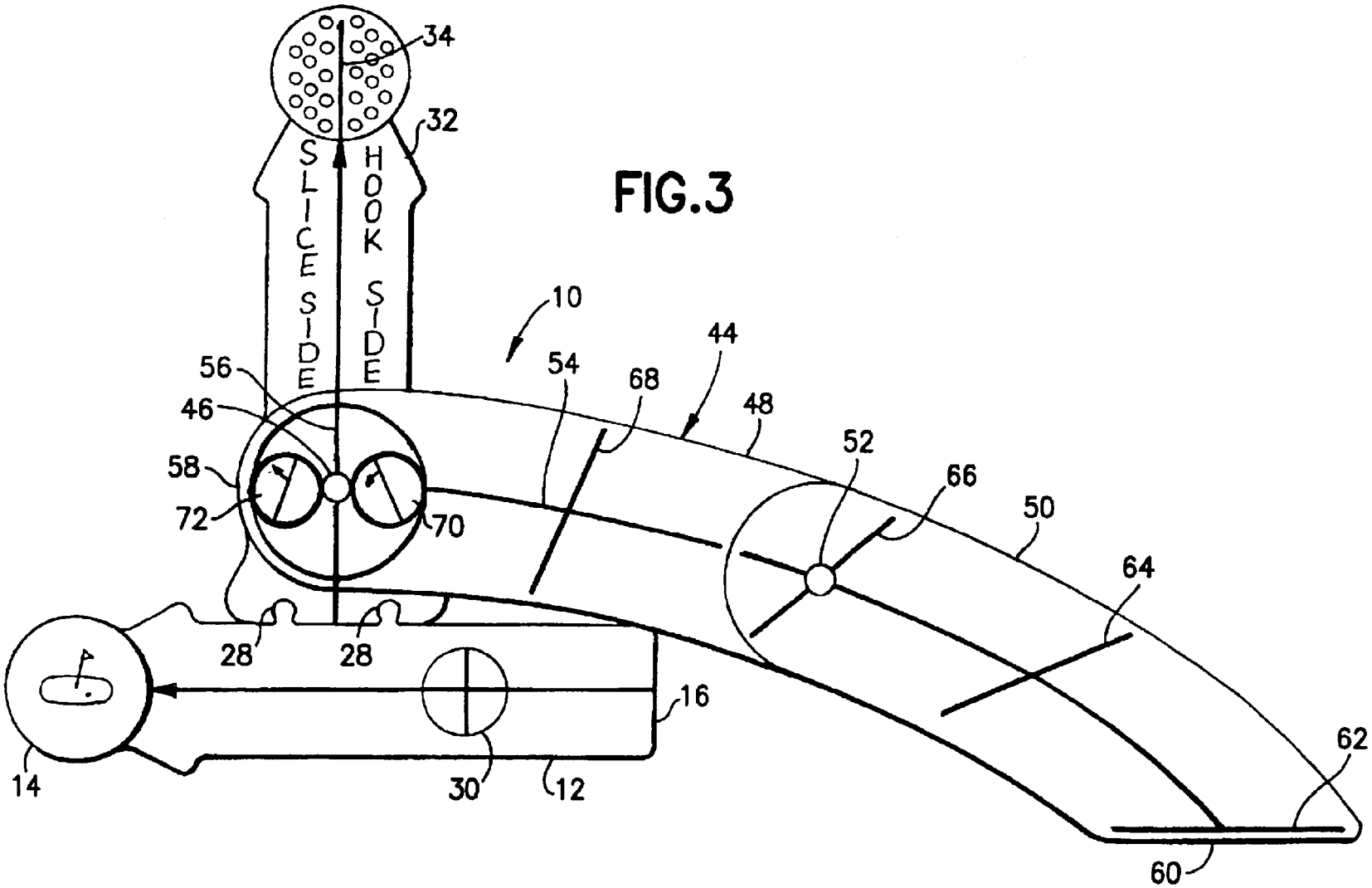
FIG. 3 is a top plan view of the golf training device when deployed for use.

The top surface of the hand alignment guide 44 is provided with indicia to help achieve proper set-up of the hand alignment guide 44 and to guide the swing of the golfer. In particular, the top surface of the hand alignment guide includes a hand alignment axis 54 that extends symmetrically along the length of the hand alignment guide 44 from the extreme front end to the extreme rear end including passage through the pivot points 46 and 52. The front arc segment 48 further includes a ball center line 56 that passes through the front pivot point 46 substantially perpendicularly to the hand alignment axis 54. The hand alignment guide 44 is set up from the FIG. 1 collapsed condition to the FIG. 3 assembled condition by rotating the front arc segment 48 about the front pivot point 46 until the ball center line 56 is substantially coincident with the ball alignment arrow 34. The rear arc segment 50 then is pivoted about the rear pivot point 52 relative to the front arc segment 48 so that portions of the hand alignment axis 54 on the front and rear arc segments 48 and 50 align with one another.

The hand alignment guide 44 and the hand alignment axis 54 define a continuous arc with a concave side facing towards the golfer and towards the foot alignment strip 12. The arc of the hand alignment guide 44 has a front end 58 substantially aligned with the front edge of the ball alignment marker 32 and a rear end 60 well rearwardly of the foot alignment strip 12. The total chordal length from the front end 58 to the rear end 60 is about 18–30 inches, and preferably about 20 inches (51 cm). The chordal distance from the front pivot point 46 to the rear extreme of the hand alignment axis 54 preferably is about 17 inches (43 cm). The hand alignment axis defines a flat approximately circular arc with a radius of approximately 42 inches (107 cm). The arc defined by the hand alignment axis 54 is selected to substantially parallel the arc that ideally should be followed by the hands of the golfer through the last 90° of the down swing for most golfers when the golf training device 10 is positioned so that the hand alignment axis 54 is slightly beyond the position of the hands. As explained further below, the hand alignment guide 44 provides a visual guide for a preferred path of travel by the hands during a normal golf swing. This visual alignment can be enhanced by forming the hand alignment guide in a color that will stand out clearly when the golf training device 10 is placed on the grass or on a mat at a driving range. In this regard, the colors of the foot alignment strip 12 and the ball alignment marker 32 are not very important and these components of the device 10 can be formed from a white plastic. However, the hand alignment guide 44 preferably is formed by a much brighter and more visibly apparent color, such as red. Furthermore, the hand alignment axis 54 preferably is provided in a color that will stand out clearly on the hand alignment guide. Various color combinations can work well. However, a black hand alignment axis 54 on a red hand alignment guide 44 has proved to provide good visual signals when the device 10 is employed on grass or on a driving range mat.

The hand alignment guide 44 further includes shaft alignment lines 62, 64, 66 and 68 that extend completely across the hand alignment guide 44 and intersect the hand alignment axis 54 at spaced apart locations. More particularly, a rear shaft alignment line 62 is disposed substantially at the rear end 60 of the hand alignment guide 44 and extends approximately parallel to the foot alignment strip 12. However, the rear shaft alignment line 62 is on a line between the feet of the golfer and the foot alignment strip 12. More particularly, an extension of the rear shaft alignment line 62 would intersect an extension of the ball alignment arrow 34 at a location approximately 2 inches (5 cm) towards the golfer as measured from the longitudinal axis of the foot alignment strip 12. The rear shaft alignment line 62 identifies a preferred alignment of the shaft of the golf club when the hands of the golfer start to move into the range of peripheral vision of the golfer. Shaft alignment lines 64, 66 and 68 represent preferred shaft alignments at more advanced locations in the swing. Extensions of the shaft alignment lines 64 and 66 will intersect an extension of the ball alignment arrow 34 at locations close to the intersection of the rear shaft alignment line 62 with the ball alignment arrow 34. This relationship reflects the fact that the wrists of the golfer should remain nearly completely flexed or cocked through a major portion of the golf swing. The front shaft alignment line 68, however, is aligned so that an extension of the front shaft alignment line 68 will intersect an extension of the ball alignment arrow 34 at a position much more rearwardly, and specifically about 10–15 inches (25–62 cm) from the foot alignment strip 12, and defines an angle of about 30° to the ball center line 56. This significantly different alignment of the front shaft alignment line 68 reflects the fact that the wrists have begun moving from the fully cocked position further back in the swing to the fully extended position at the point of contact and the forearms have begun to roll over one another. In this regard, the device 10 trains for proper execution of the several bodily pivots that should occur in the golf swing. More particularly, the hand alignment axis 54 defines hand positions attributable to the pivoting of the shoulders roughly about the spine. The shaft alignment lines 60–68 define preferred shaft alignments attributable to the pivoting of the wrists and the rolling over of the forearms at several different hand positions.

The golf training device 10 initially is stored in the very compact condition shown in FIGS. 1 and 2, and ma be packaged in an envelope. The pivoted assembly of the ball alignment marker 32 and the hand alignment guide 44 is moved away from the foot alignment strip 12 and the foot alignment strip 12 is placed on the ground. The non-pointed end of the ball alignment marker 32 then is connected to the foot alignment strip 12. The front and rear arc segments 48 and 50 of the hand alignment guide 44 then are pivoted into the orientation shown in FIG. 3. In particular, the ball center line 56 on the front arc segment 48 is aligned to coincide with the ball alignment arrow 34. Additionally, portions of the hand alignment axis 54 disposed on the front and rear arc segments 48 and 50 are aligned with one another to form a complete continuous arc.

The golf training device 10 then is positioned on the ground approximately midway between the ball or tee and the position where the golfer is likely to stand to address the ball. This initial positioning is approximate. The golfer then orients the foot alignment strip to point at the target and shifts the foot alignment strip longitudinally so that the ball alignment arrow 34 points towards the ball. The preceding assembly and initial alignment steps typically will take much less then a minute to complete. The golfer then assumes an initial stance with the front of the feet substantially equally spaced from the longitudinal extension of the foot alignment strip 12 and with the feet spaced from the ball or tee a convenient distance for the golfer's normal address of the ball. The golfer then may adjust the position of the golf training device 10 by moving the device 10 towards or away from the ball along the line defined by the ball alignment arrow so that the foot alignment strip 12 is approximately halfway between the golfer's feet and the ball. The golfer then addresses the ball and adjusts his or her position in directions parallel to the foot alignment strip 12 so that the golfer's head substantially aligns with the head alignment indicia on the foot alignment strip. Thus, the golfer's head will be slightly rearwardly of the ball.

The golfer then assumes a normal back swing with a hip pivot comfortable for the golfer, a shoulder pivot of about 90° and with the hands in a convenient starting position for the start of the particular swing required for the intended shot. The golfer's wrist will be in a maximum cocked position at the extreme back of the back swing. Thus the shaft may be angled down towards the ground at about 45°. The golfer may watch the hands during the first several practice swings to achieve the hand and shaft alignments indicated by the hand alignment axis 54 and the shaft alignment lines 60–68. The golfer eventually focuses on the ball during the down swing. The golfer's hands will move into the golfer's range of peripheral vision approximately when the hands reach the rear end 62 of the hand alignment guide 44. The hands at this point will be close to and typically inward from the hand alignment axis 54 at this point in the swing and will generally follow the line defined by the hand alignment axis 54. The golfer's peripheral vision permits the golfer to check on this important part of the swing from the time where the hands enter the field of peripheral vision to the time when contact with the ball is made. Significant variation of the hand position from the arc defined by the hand alignment axis 54 can be noted by the golfer and can be adjusted during subsequent practice swings. It is important to note, that the hands need not be precisely on the hand alignment axis, but rather substantially parallel to the hand alignment axis. Smaller golfers may have their hands inwardly from the hand alignment axis, while bigger golfers may have their hands directly on the hand alignment axis 54. In either of these situations, the hand alignment axis 54 provides a very clear visual cue for the proper track of the hands through the important finishing stages of the down swing.

The device 10 further permits the golfer to align the shaft properly through the down swing. In particular, portions of the shaft adjacent the hand should substantially parallel the shaft alignment lines 62–68 at the various positions through the swing. The shaft alignment lines 62–68 will train the golfer to keep the wrists and hence the shaft in a cocked position until the hands align with the front shaft alignment line 68 where the uncocking or breaking of the wrists commences. Thus, the golf training device 10 enables the golfer to develop a swing where the hands move through the proper arc and with the shaft aligned for developing exceptional power at the bottom of the swing as the club head is approaching the ball.

Importantly, the device 10 does not attempt to track the position of the club head, but rather relies upon the positions of the hands throughout the swing and the alignment of the hands and shaft throughout the swing. These are variables that can be controlled easily by the golfer and automatically lead to a proper position of the golf club head. Additionally, the hand and shaft alignments are achieved merely by relying upon the normal peripheral vision of the golfer. The device 10 differs from known devices that require actual contact between the shaft or head. The device 10 does not rely upon contact with any part of the golfer or the golf club and relies upon visual impressions that will remain with the golfer when the golfer leaves the practice tee for the actual golf course.

The hand alignment guide 44 includes hook and slice indicia 70 and 72 on opposite respective sides of the ball center line 56. In particular, the hook indicia 70 is rearward of the pivot point 46, while the slice indicia 72 is forward of the pivot point 46. The hook and slice indicia 70 and 72 can be used to develop an intentional hook or slice that can be useful in certain situations, such as hitting around an obstacle, such as a tree. In this regard, the golfer can intentionally develop a hook by moving the entire device forwardly so that the hook indicia 70 points towards the ball. Conversely, the golfer can achieve an intentional slice by moving the entire device 10 rearwardly so that the slice indicia 72 points towards the ball. The hook and slice indicia 70 and 72 also can be used to help correct unintended hooks or slices.

While the invention has been described with respect to certain preferred embodiments, it is apparent that various changes can be made without departing from the scope of the invention as defined by the appended claims.

What is claimed is:

1. A golf training device comprising:

a foot alignment strip having opposite front and rear ends and a substantially linear longitudinal axis extending between the ends;

a ball alignment marker extending transversely from the foot alignment strip and having a center line aligned substantially perpendicular to the longitudinal axis of the foot alignment strip; and a hand alignment guide having a front end on the ball alignment marker and an opposed rear end, the hand alignment guide defining an arc with a concave side facing towards the foot alignment strip, a plurality of shaft alignment lines extending transversely across the hand alignment guide at spaced apart locations between the front and rear ends of the hand alignment guide, the shaft alignment lines including a rear shaft alignment line in proximity to the rear end of the hand alignment guide and a front shaft alignment line in proximity to the ball alignment marker, the rear shaft alignment line being substantially normal to the center line of the ball alignment marker and the front shaft alignment line defining an acute angle to the center line of the ball alignment marker.

2. The golf training device of claim 1, wherein the ball alignment marker is removably attached to the foot alignment strip.

3. The golf training device of claim 2, wherein the hand alignment guide is pivotally mounted to the ball alignment marker.

4. The golf training device of claim 3, wherein the hand alignment guide includes a front arc segment pivotally connected to the ball alignment marker and a rear arc segment pivotally connected to the front arc segment.

5. The golf training device of claim 4, wherein the rear end of the hand alignment guide is rearward of the rear end of the foot alignment strip.

6. The golf graining device of claim 1, wherein the foot alignment strip, the ball alignment marker and the hand alignment guide all are formed from substantially planar sheets of material.

7. The golf training device of claim 6, wherein the planar sheets of material are planar sheets of a resin material.

8. The golf training device of claim 6, wherein the hand alignment guide is formed from a planar sheet of material that is a different color than colors of the foot alignment strip and the ball alignment marker.

9. The golf training device of claim 1, further comprising a hook marker on the hand alignment guide rearward of ball center line and a slice marker on the hand alignment guide forward of the ball center line.

* * * * *